US006345624B1

(12) United States Patent
Kastner

(10) Patent No.: US 6,345,624 B1
(45) Date of Patent: Feb. 12, 2002

(54) COMPACT CIGARETTE MAKING MACHINE

(75) Inventor: Arnold Kastner, Montreal (CA)

(73) Assignee: CTC Canada Inc., Montreal (CA)

( * ) Notice: Subject to any disclaimer, the term of this patent is extended or adjusted under 35 U.S.C. 154(b) by 0 days.

(21) Appl. No.: 09/476,345

(22) Filed: Jan. 3, 2000

(51) Int. Cl.[7] ..... A24C 5/02; A24C 1/18
(52) U.S. Cl. ..... 131/70; 131/75
(58) Field of Search ..... 131/70, 71, 72, 131/73, 74, 75, 76

(56) References Cited

U.S. PATENT DOCUMENTS 3,741,220 A * 6/1973 Meinunger ..... 131/70
4,771,793 A * 9/1988 Kastner ..... 131/70

* cited by examiner

*Primary Examiner*—Stanley S. Silverman
*Assistant Examiner*—Dionne A. Walls
(74) *Attorney, Agent, or Firm*—Swabey Ogilvy Renault; Guy J. Houle

(57) ABSTRACT

A compact cigarette making machine for compacting and inserting a quantity of tobacco into a preformed cigarette tube is described. A tobacco receiving member is slidably retained within a base and movable longitudinally thereon to load tobacco into a cigarette tube secured to a nipple at its forward end. A cover is pivotally secured to the rearward end of the tobacco receiving member and slidable therewith with respect to the base. The cover is pivotally movable from an open position to a closed position overlying the tobacco receiving member. The cover is substantially of the same width as the base and has a pair of opposed inner tongues engagable under a respective elongated flange which projects inside the open channel-shaped base from opposed side walls thereof when the tobacco receiving member is retracted rearwardly over the base. Accordingly, the cigarette making machine is very compact in dimension and can be easily carried by a user person.

5 Claims, 4 Drawing Sheets

COMPACT CIGARETTE MAKING MACHINE

TECHNICAL FIELD

The present invention relates to a small, lightweight and economically manufactured cigarette making machine which may be readily carried in a pocket or purse of a user person to enable a cigarette to be made at any desired time. More specifically, the invention relates to a cigarette making machine of the injection type wherein a supply of tobacco is compacted into cylindrical form, and is injected into a preformed cigarette tube positioned on the machine and operable, if desired, by a single hand.

BACKGROUND ART

The cigarette making machine of the present invention is an improvement of the machine described in my earlier U.S. Pat. No. 4,771,793 issued on Sep. 20, 1988. This patent is the closest known prior art.

SUMMARY OF INVENTION

Some of the features of the present invention are to provide a cigarette making machine which is very compact, easy to assemble, uses minimal plastic material in its fabrication and which can easily be customized. The machine is a streamlined elongated rectangular body which easily fits in the hand of the user and is operable with a single hand, if desired,. There are no side projection parts extending out of the rectangular smooth body.

According to the above feature of the present invention there is provided a compact cigarette making machine for compacting and inserting a quantity of tobacco into a preformed cigarette tube. The machine comprises a base of upwardly open channel-shape and having forward and rearward ends and an elongate tobacco injection spoon having a free end and having a concave cross-section secured at a predetermined elevated position within the base and stationary therewith. A tobacco receiving member is slidably retained within the base and movable to a position extending longitudinally outwardly from the rearward end of the base. The tobacco receiving member has at its forward end a removable partition carrying a hollow circular nipple to receive the open end of a preformed cigarette tube. The free end of the injection spoon passes through the hollow nipple during rearward movement of the tobacco receiving member with respect to the base. An elongate slot is provided in and extends through the tobacco receiving member to receive a quantity of tobacco. A cover is pivotally secured to the rearward end of the tobacco receiving member and slidable therewith with respect to the base. The cover is pivotally movable from an open position to a closed position overlying the tobacco receiving member. A tobacco compacting projection is also provided and has a lower surface which is concave in cross section and is carried by the cover and closes the top portion of the elongated slot when the cover is in closed position to compact tobacco inserted in the slot and onto the tobacco receiving member. A cigarette tube retainer is also provided and has a circular concave surface on the cover forwardly of the tobacco compacting projection. The concave surface of the retainer bears against the cigarette tube positioned on the nipple to hold the tube in position during tobacco injection. Bottom slot retaining means are provided in a lower portion of the base for slidingly engaging the tobacco receiving member. The cover is substantially of the same width as the base and has a pair of opposed inner tongues engagable under a respective elongated flange projecting inside the open channel-shaped base from opposed side walls thereof when the tobacco receiving member is retracted rearwardly over the base.

According to a further broad aspect of the present invention the cigarette making machine is a substantially elongated rectangular member having no outward projecting flanges and which is comfortable in the hand of a user and which can be operated by a single hand, if desired.

According to a further broad aspect of the present invention the cigarette making machine of the present invention is easy to assemble, uses less plastic material than prior art machines and may be customized for advertising purposes.

BRIEF DESCRIPTION OF DRAWINGS

A preferred embodiment of the present invention will now be described with reference to the accompanying drawings in which.

DESCRIPTION OF PREFERRED EMBODIMENTS

Figures 2, 3:
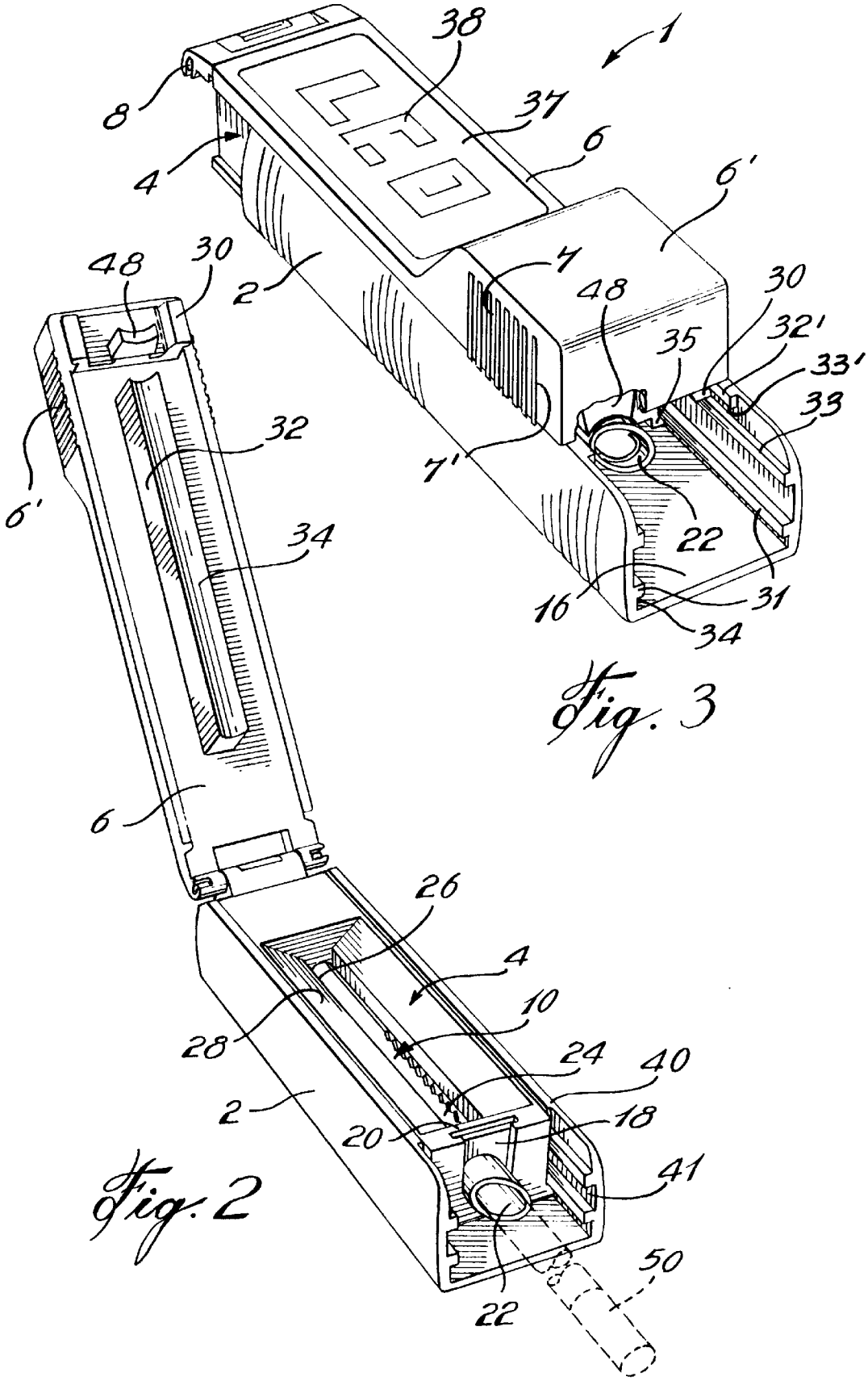
FIG. 2 is a perspective view showing the cigarette making machine in a loading position with the cover hinged outwardly.
FIG. 3 is a perspective view of the cigarette making machine of the present invention and showing the tobacco receiving member partially retracted from the base.

With reference primarily to FIGS. 1 to 4, the present machine 1 consists of three major component parts comprising a hollow channel-shaped base 2, a tobacco receiving member 4 which is slidably movable in the base 2 from the forward position shown in FIG. 2 to a rearwardly retractable position as demonstrated in the prior art patent referred to above. A cover portion 6 is pivotally hinged to the rear of the tobacco receiving member 4 by suitable means such as pivot pin 8.

These three component parts 2, 4 and 6 may conveniently be molded of suitable plastics material for economy of manufacture, although other materials such as metals could be used if desired. However, plastics is the preferred material.

Figure 5:
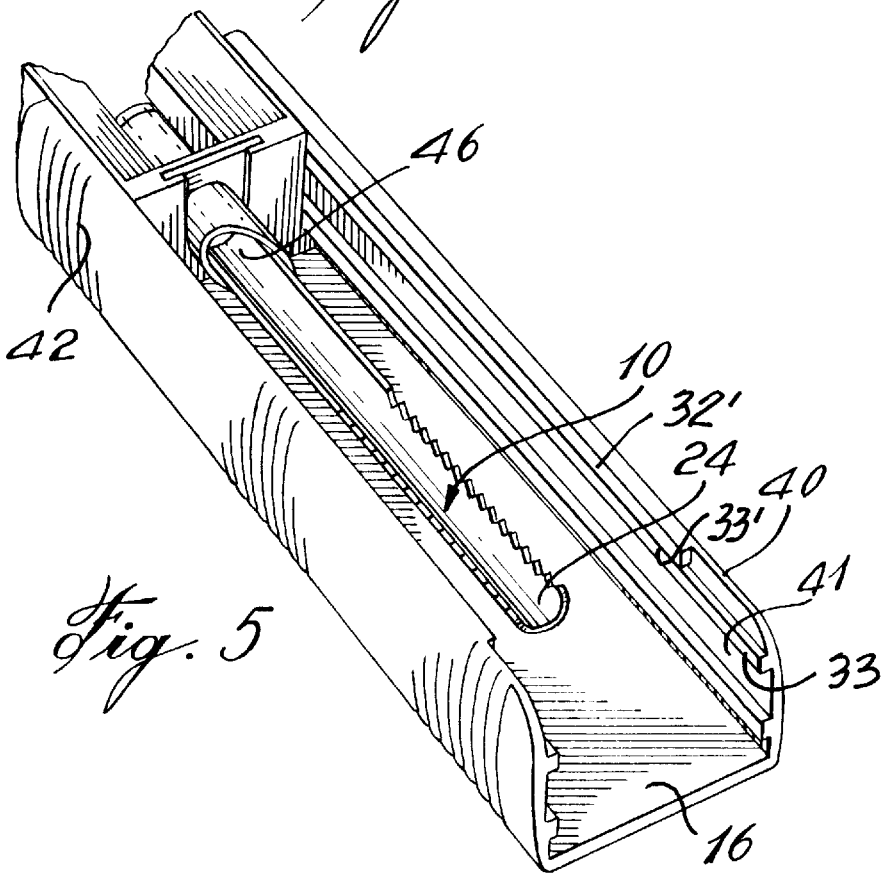
FIG. 5 is a perspective view showing the construction of the base.

An injection spoon 10 (see FIGS. 2 and 5) is secured within base 2 and is stationary herewith. The spoon which may be of metal or plastic is removably secured to the base to facilitate cleaning and/or replacement if necessary. The spoon 10 is retained elevated from the bottom wall 16 of the base, as shown in FIG. 5.

The tobacco receiving member 4 carries at its forward end a removable partition 18 (see FIGS. 2 and 6) which is received in slots 20 provided on both sides of the front end 4' of the tobacco receiving member 4. Secured to the partition 18 is a circular hollow nipple 22 which is adapted for insertion into the open end of a preformed paper cigarette tube 50, shown in phantom lines and well known in the art. The outer diameter of the nipple 22 is of a size to snugly receive the open end of a cigarette tube 50 thereover.

As partition 18 and nipple 22, which may be of plastic or metal as desired, are readily removable from the machine, cleaning and/or replacement is facilitated.

Because the injection spoon 10 is securely held by the base and as partition 18 and nipple 22 are movable with the tobacco receiving member 4, rearward movement of the tobacco receiving member 4 with respect to the base 2 will result in the free end 24 of the spoon 10 passing through and extending beyond the nipple 22 and into the tube 50.

As shown in FIG. 2, the central portion of the tobacco receiving member 4 is provided with a top slot opening 26 with upper outwardly sloping surfaces 28. When the tobacco receiving member 4 is positioned forwardly within base 2 as shown in FIG. 2, the upwardly concave spoon 10 is positioned directly beneath the slot 26 and a quantity of tobacco sufficient for one cigarette is positioned within slot 26 and pushed downwardly into contact with the injection spoon 10. This positioning of the tobacco in the slot is facilitated by the inwardly sloping surfaces 28 and also through the use of a tamper device (not shown) and as described in my earlier patent.

Figure 1:
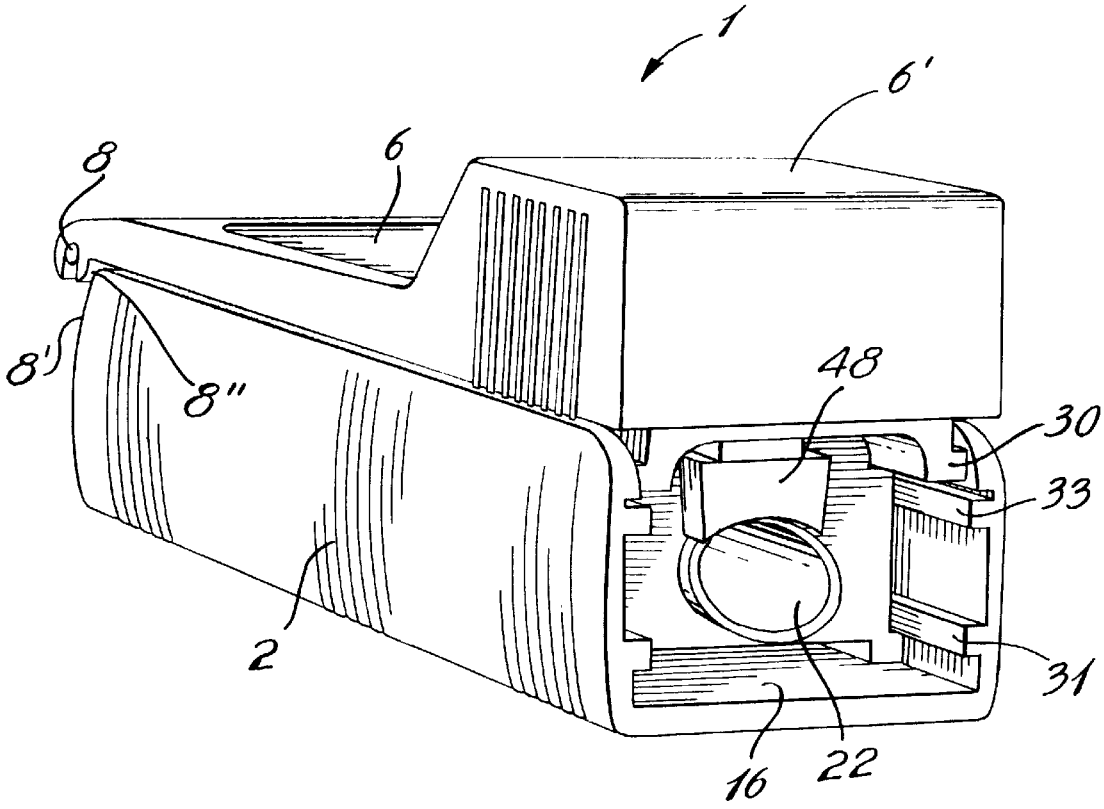
FIG. 1 is a perspective frontal view of the cigarette making machine of the present invention.

As discussed above, the cover 6 is pivotally secured to the tobacco receiving member 4 and is movable from a closed position shown in FIG. 1 to an open position shown in FIG. 2. On its lower surface, the cover 6 is provided with a tobacco compacting projection 32 having a lower surface 34 which is concave in cross-section and which is of a size to be received within the slot 26 provided in the tobacco receiving member 4 when the cover is lowered to the position shown in FIG. 1. In this position, of course, the tobacco which is to be injected into a preformed cigarette tube is compacted and more or less shaped by confinement within a cavity formed by the upper concave surface of the spoon 10, the side walls of the slot 26 and the lower concave surface 34 of the tobacco compacting projection carried by the cover.

Figure 4:
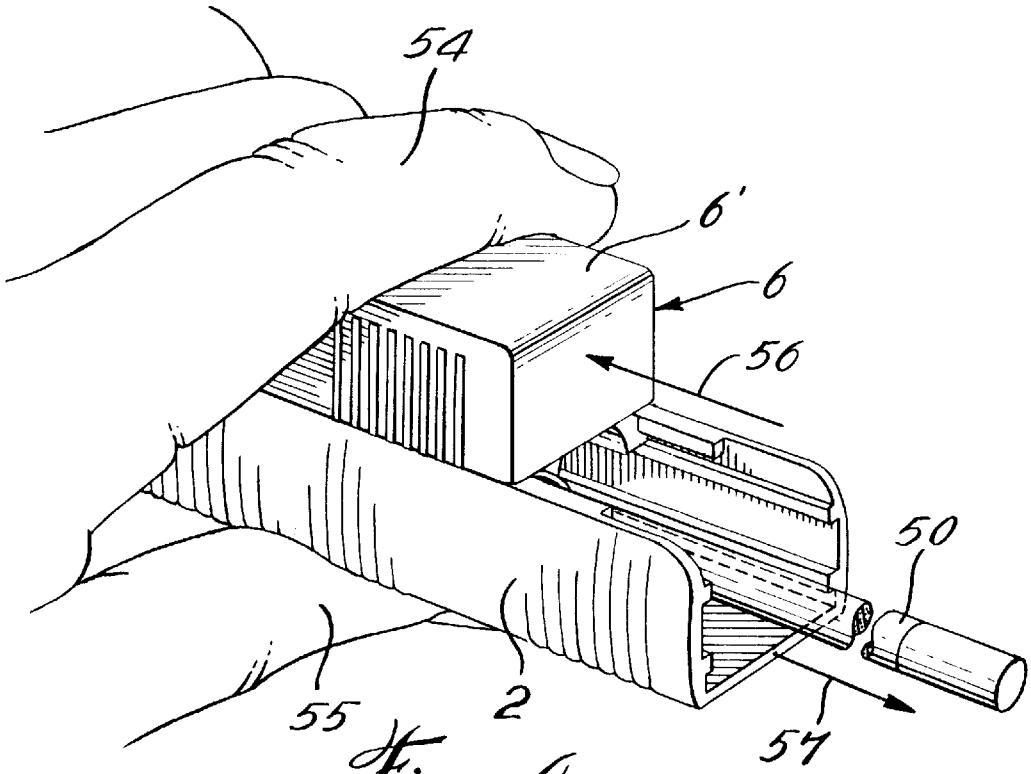
FIG. 4 is a perspective view showing how the cigarette making machine of the present invention is operable by a single hand of a user person.

The cover 6 is of the same width as the base 2 and together they form a compact, elongated, rectangular machine free of outer projections making it comfortable to grasp by the hand, as shown in FIG. 4 and operate by a single hand, if desired. It is also easy to carry by a user person.

Figure 6:
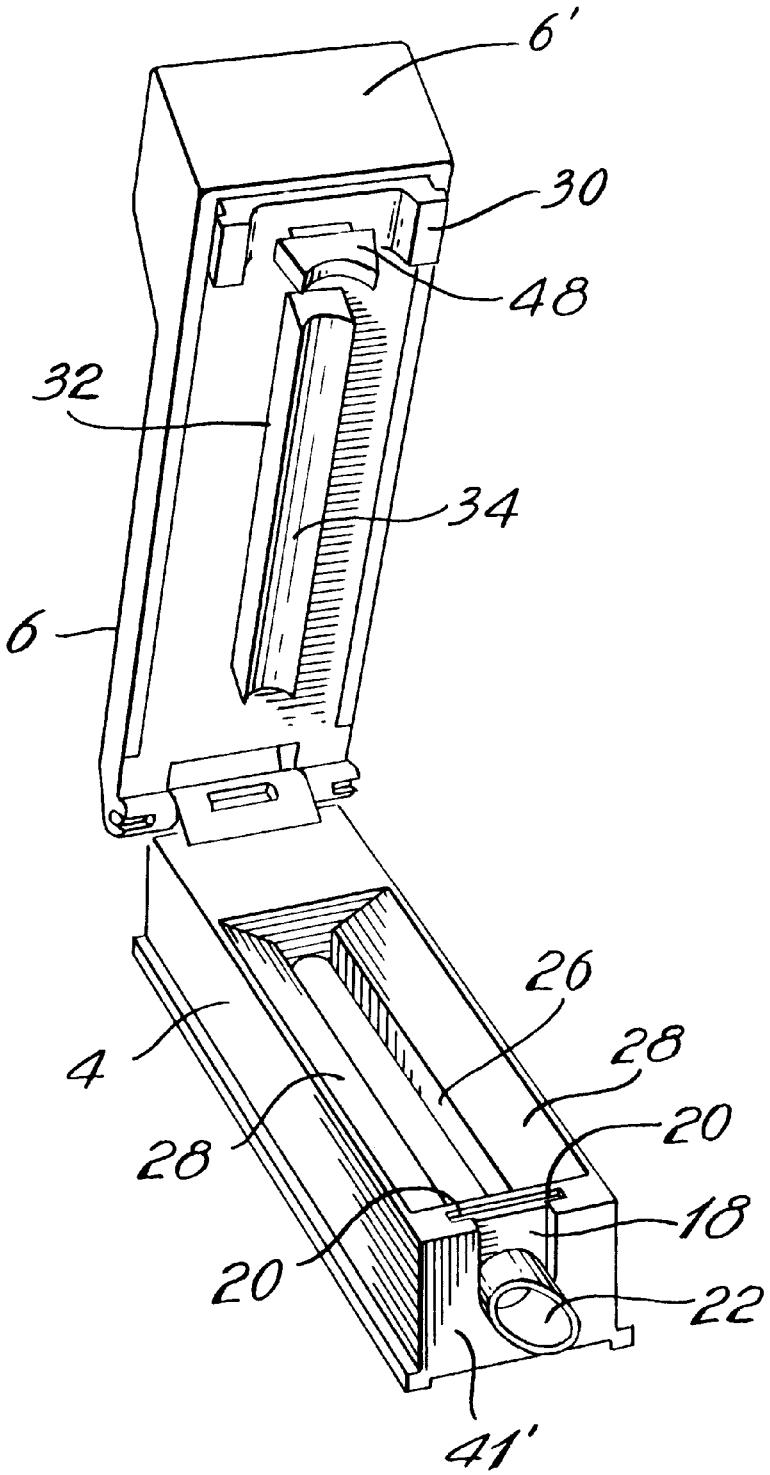
FIG. 6 is a perspective view of the tobacco receiving member which is slidingly secured within the base as shown in FIG. 5.

As shown in FIGS. 1 to 3, bottom slot retaining means in the form of opposed ribs 31 are formed with and extend adjacent the bottom wall 16 of the base whereby to retain captive thereunder, in the channel 34 formed between the ribs 31 and the bottom wall 16, a respective one of a pair of projecting feet 35 formed integral with the bottom corners of the tobacco receiving member 4. The forward end of the cover 6 has an enlarged section 6' which is provided with ribs 7 on opposed side wall 7' thereof for finger gripping engagement. A pair of opposed inner tongues 30 project from under the forward portion of the cover and are engagable under a respective elongated flange 32' projecting inside the open channel-shaped base and formed adjacent the top edge 40 of the side walls 41 of the base, as clearly shown in FIG. 5. A lower rib 33 is also provided spaced from the elongated flange 32' to form a guide channel 33' therebetween. When the cover is in its forward position, as shown in FIG. 1, these tongues 30 are disposed forward of the channel 33' and therefore permitting the cover to be hinged outwardly to its loading position as shown in FIGS. 2 and 6. The side walls 41 of the base may also be provided with ribs 42 for ease of gripping.

As shown in FIG. 3, the top wall 37 of the cover may be provided with advertising material 38 either embossed thereon or affixed thereto for advertising purposes or to customize the machine.

With further reference to FIGS. 5 and 6, it is pointed out that in order to assemble the cigarette making machine, it is simply necessary to slide the tobacco receiving member 4 into the base from the forward end thereof with the cigarette tube retainer 10 extending thereunder and spaced above the bottom wall 16 of the base. The cover may then be assembled to the tobacco receiving member with the rear end of the cover having an abutment edge to abut the top rear edge 8" of the base member to prevent the tobacco receiving member from sliding forwardly out of the base.

During rearward movement of the cover 6 and tobacco receiving member 4 with respect to the base 7 as shown in FIG. 4, a compacted wad of tobacco is injected into a preformed cigarette tube 50 positioned on the nipple 22 (see FIG. 2). As shown in FIG. 5, the spoon 10 is provided with a stop or abutment 46 which ensures that the tobacco positioned on the spoon is carried into the cigarette tube.

A cigarette tube 50 is held in position on the nipple 22 by a cigarette tube retainer 48 provided on the underside of the cover and forwardly of the tobacco compactor 32 as shown in FIGS. 1 to 3. When a cigarette tube 50 is positioned on the nipple and the cover lowered, the cigarette tube retainer contacts the tip of the cigarette tube and holds the tube in position on the nipple during the injection process. Conveniently, the concave lower surface of the tube retainer may be provided with a thin soft layer 51 (see FIG. 1) of a compressible material such as sponge rubber or foam plastic to snugly secure the tube 50 onto the nipple without danger of tearing the cigarette paper tube.

To use the machine, the cover 6 is first opened to the position shown in FIG. 2, and the open end of a preformed cigarette tube 50 is positioned on the nipple 22. Then, with the tobacco receiving member 4 positioned completely within the base 2 as shown in FIG. 1, a supply of tobacco sufficient for one cigarette is placed into the tobacco receiving slot 26 and pressed into the slot either with the fingers or by using a tamper. The cover is then closed to the position shown in FIG. 1 wherein the cigarette tube retainer 48 contacts and holds the tip of a cigarette tube on nipple 22, as shown in FIG. 2. The base 2 of the machine is then held with one hand while the other hand slides the cover and the tobacco receiving member rearwardly with respect to the base to a fully retracted position. As discussed above, and as the injection spoon 10 is stationary with respect to the base and as the cigarette tube is carried rearwardly by nipple 22, the forward portion of the spoon and the wad of tobacco (not shown) enter the cylindrical cavity of the cigarette tube.

The cover is then moved forwardly with respect to the base to the forward position shown in FIG. 1 retracting the spoon only form the tube 50, and the cover raised (see FIG. 2) to remove the tube retainer 48 from the cigarette tube 50 to permit removal of the filled cigarette from the nipple.

As previously described, because of the compactness of the design, a cigarette may be formed using a single hand, as shown in FIG. 4. The index finger 54 is positioned over the enlarged front end 6' of the cover and the thumb 55 under the base. The cover 6 is pulled back in the direction of arrow 56 while the thumb 55 pushes the base 2 forward in the direction of arrow 57.

It is within the ambit of the present invention to cover any obvious modifications provided these fall within the scope of the appended claims.

What is claimed is:

1. A compact cigarette making machine for compacting and inserting a quantity of tobacco into a preformed cigarette tube, said machine comprising a base of upwardly open channel shape having forward and rearward ends and an elongate tobacco injection spoon having a free end and having a concave cross-section secured at a predetermined elevated position within the base and stationary therewith, and a tobacco receiving member slidably retained within the base and movable to a position extending longitudinally outwardly from the rearward end of the base, the tobacco receiving member having at its forward end a removable partition carrying a hollow circular nipple to receive the open end of a preformed cigarette tube, the free end of the injection spoon passing through the hollow nipple during rearward movement of the tobacco receiving member with respect to the base, and an elongate slot provided in and extending through the tobacco receiving member to receive a quantity of tobacco, and a cover pivotally secured to the rearward end of the tobacco receiving member and slidable therewith with respect to the base, the cover being pivotally movable from an open position to a closed position overlying the tobacco receiving member, and a tobacco compacting projection having a lower surface which is concave in cross-section carried by the cover and which closes a top portion of the said elongate slot when the cover is in closed position to compact tobacco inserted in said slot and onto said tobacco receiving member, a cigarette tube retainer having a circular concave surface on the cover forwardly of the tobacco compacting projection, the concave surface of the retainer bearing against a cigarette tube positioned on the nipple to hold the tube in position during tobacco injection, bottom slot retaining means in a lower portion of said base for slidingly engaging said tobacco receiving member, said cover being substantially of the same width as said base and having a pair of opposed inner tongues engagable under a respective elongated flange projecting inside said base of open channel shape base from opposed side walls thereof when said tobacco receiving member is retracted rearwardly over said base.

2. A compact cigarette making machine according to claim 1, wherein said tongues are short tongues disposed at a forward end under said cover, said elongated flange having a front end disposed rearwardly of said tongues when said cover is disposed in its closed unretracted position.

3. A compact cigarette making machine according to claim 2, wherein said cover has an enlarged rectangular forward end provided with gripping ribs on opposed side walls thereof.

4. A compact cigarette making machine according to claim 3, wherein gripping ribs are disposed along said side walls of said base.

5. A compact cigarette making machine according to claim 4, wherein said side walls of said cover and side walls of said base lie in a substantially common plane.

* * * * *